US010711328B2

(12) United States Patent
Rodríguez Angoli et al.

(10) Patent No.: US 10,711,328 B2
(45) Date of Patent: Jul. 14, 2020

(54) LOW-LEAD COPPER ALLOYS

(71) Applicant: Nacional de Cobre, S.A. de C.V., Cuidad de México (MX)

(72) Inventors: Jaime Rodríguez Angoli, Guanajuato (MX); Julio Alberto Rosas Franco, Guanajuato (MX); Roberto Montoya Rodriguez, Guanajuato (MX)

( * ) Notice: Subject to any disclaimer, the term of this patent is extended or adjusted under 35 U.S.C. 154(b) by 109 days.

(21) Appl. No.: 15/678,291

(22) Filed: Aug. 16, 2017

(65) Prior Publication Data

US 2018/0230574 A1 Aug. 16, 2018

(30) Foreign Application Priority Data

Feb. 10, 2017 (MX) ..... MX/a/2017/001955

(51) Int. Cl.
*C22C 9/04* (2006.01)
*C22F 1/08* (2006.01)

(52) U.S. Cl.
CPC . *C22C 9/04* (2013.01); *C22F 1/08* (2013.01)

(58) Field of Classification Search
CPC ..... C22C 9/04; C22F 1/08
See application file for complete search history.

(56) References Cited

U.S. PATENT DOCUMENTS

| | | | | |
|---|---|---|---|---|
| 4,822,560 | A * | 4/1989 | Oyama | C22C 9/02 148/433 |
| 6,942,742 | B2 * | 9/2005 | Yamagishi | C22C 9/04 148/433 |
| 7,090,732 | B2 * | 8/2006 | Usami | C22C 9/06 148/433 |
| 7,172,662 | B2 * | 2/2007 | Usami | C22C 9/02 148/433 |
| 7,351,372 | B2 * | 4/2008 | Inohana | C22C 9/02 148/433 |
| 8,273,193 | B2 * | 9/2012 | Xu | C22C 9/04 148/433 |
| 8,968,492 | B2 * | 3/2015 | Uchida | C22C 9/04 148/434 |
| 2004/0140022 | A1 * | 7/2004 | Inohana | C22C 9/02 148/553 |
| 2004/0241038 | A1 * | 12/2004 | Hofmann | C22C 9/04 420/472 |
| 2005/0039827 | A1 * | 2/2005 | Yamagishi | C22C 9/04 148/554 |
| 2014/0251488 | A1 * | 9/2014 | Oishi | C22C 9/04 138/177 |
| 2016/0068931 | A1 * | 3/2016 | Xu | C22F 1/08 420/471 |

* cited by examiner

*Primary Examiner* — Cam N. Nguyen
(74) *Attorney, Agent, or Firm* — Eugenio J. Torres-Oyola; Victor M. Rodriguez-Reyes; Rafael Rodriguez-Reyes

(57) ABSTRACT

The present invention relates to a copper-zinc alloy with low lead content, as well as a process for the manufacturing of the same. The obtained allow allows the restriction of the amount of the generated Beta phase, thereby causing a lower deterioration of the materials due to the loss of zinc during its exposure to ponded, low movement or slightly acid waters.

12 Claims, 8 Drawing Sheets

| DESCRIPCION | SECCION ANALIZADA | |
|---|---|---|
| | LONGITUDINAL | TRANSVERSAL |
| Total de Área Expuesta | 100mm2 | 100mm2 |
| Numero de Mediciones | 32 | 25 |
| Tipo de Penetración | Puntual | En Bandas |
| Promedio de la profundidad de penetración (micrón) | 34.87 | 116.1 |
| Máxima profundidad de penetración (micrón) | 123.4 | 178.5 |
| Desviación estándar (profundidad de penetración) | 25.13 | 38.05 |
| Aumento usado en la medición | 500X | 500X |

| LONGITUDINAL | TRANSVERSAL |
|---|---|
|  50X |  50X |
|  500X |  500X |

| DESCRIPCION | SECCION ANALIZADA LONGITUDINAL | TRANSVERSAL |
|---|---|---|
| Total de Área Expuesta | 100mm2 | 100mm2 |
| Numero de Mediciones | 30 | 27 |
| Tipo de Penetración | Puntual | Puntual |
| Promedio de la profundidad de penetración (micrón) | 115.6 | 39.2 |
| Máxima profundidad de penetración (micrón) | 201.7 | 109.3 |
| Desviación estándar (profundidad de penetración) | 63.2 | 29.3 |
| Aumento usado en la medición | 500X | 500X |

| DESCRIPCION | SECCION ANALIZADA Pieza forjada 2802 |
|---|---|
| Total de Área Expuesta | 100mm2 |
| Numero de Mediciones | 19 |
| Tipo de Penetración | Puntual |
| Promedio de la profundidad de penetración (micrón) | 20.9 |
| Máxima profundidad de penetración (micrón) | 56.8 |
| Desviación estándar (profundidad de penetración) | 13.26 |
| Aumento usado en la medición | 500X |

LOW-LEAD COPPER ALLOYS

TECHNICAL FIELD

This invention refers to machinable low-lead copper alloys, which are useful in the manufacturing of plumbing components, for instance, brass components for water distribution circuits.

BACKGROUND OF THE INVENTION

Nowadays, a higher commitment is more common in the health sector, not only from medical or government institutions, but also from the private industry and society at large.

One of the branches that has gained relevance relates to metallic elements used for the conduction and distribution of water, both in the industrial and service sector, which seeks to control material used for said purpose, thereby preventing health risks caused by substances that may be transmitted by being dissolved in water, and which may cause damage in people.

On the other hand, lead is one of the main elements contained in brass for piping, due to its machinability, lead favors the leakage and braking of shavings, working as lubricant throughout the machining process, thereby reducing temperatures during the cutting process, thereby extending the life of cutting tools; however, the same is a dangerous compound which accumulates in the nervous system and is particularly dangerous for the mental development of children.

Legislation has emerged in the United States, an example of this is California's AB 1953 Assembly Bill. This project defines the term "lead free", for the purposes of the manufacturing, industrial processing and transmission or distribution of water for human consumption in the lead of piping and piping accessories, plumbing accessories, and accessories, to an intermediate lead content on the wet surface of piping systems and accessories of no more than 0.25% in weight, which means that a lower percentage of lead contained in the alloy strictly complies with the requirement for use in water conduction for human consumption.

In recent years, efforts directed to regulations for copper alloys containing lead have been carried out in order to drastically limit the allowable lead level in copper alloys. Consequently, fast cut low-lead copper alloys have been developed, reaching 0.02% in weight.

In the state of the art, several low-lead copper alloys have been described, such as the case of application MX/a/2014/013285, providing alloys and methods to form copper alloys, including red and yellow brass, containing sulfur and antimony; the alloy is hardened by copper, zinc, nickel and manganese precipitation, showing resistance and ductility with values similar to those of stainless steels in combination with machinability properties; application MX/a/2012/011929 refers to copper-based alloys with added manganese and sulfur and/or calcium, as well as secondary elements. Copper alloys ere free from tellurium and lead and are characterized by a high electric conductivity and utility for mechanization through shavings detachment. Patent MX 291315 B protects a fast cut copper ahoy containing a reduced amount of copper in comparison with other conventional fast cut copper alloys, with Industrial machining capacity. Fast cut alloys comprise from 71.5 to 78.5 percent of their weight in copper, from 2.0 to 4.5 percent of their weight in silicon, up to 0.005, but not more than 0.02 percent of their weight in lead and the remaining percentage of their weight of zinc; patent MX 221266 refers to: manufactured copper-based alloy components, designed to be subjected, during the production stage, to work operations carried out either through machining, molding or die casting, specifically plumbing components manufactured from brass alloy, designed to be used in drinking water systems, having said components the respective surfaces defined by said alloy designed to be exposed, throughout the using time. Copper-based alloys contain a previously determined lead quality; patent MX 204484 discloses lead free copper alloys with properties comparable with copper-based alloys with lead made from copper-based alloys containing bismuth.

In American patents U.S. Pat. No. 8,506,730, "Copper/zinc alloys having low levels of lead and good machinability", U.S. Pat. No. 8,349,097 "Dezincification-resistant copper alloy and method for producing product comprising the same"; U.S. Pat. No. 8,239,034 "Lead free brass alloy" and U.S. Pat. No. 8,273,192 "Lead-free, bismuth-free free-cutting phosphorous brass alloy", among other publications, which must be considered as included in the present description.

On this regard, an increasing public interest has been developed in relation to the lead content of plumbing components related to drinking water, increasing the interest in reducing the lead content even more.

Some of the attempts to reduce the lead levels in copper alloys include the introduction of other elements instead of lead, giving as result machining and finishing problems in the manufacturing process, including primary casting, primary machining, secondary machining, polished, coatings and mechanical mounting. Therefore, the need for a casting solution with a low lead alloy cast providing low cost alloys, without degradation of the mechanical or chemical properties, or a relevant interruption of the manufacturing process for the material, causing finishing and cutting problems.

BRIEF DESCRIPTION OF THE INVENTION

The purpose of this invention is to provide a composition of matter comprising approximately: 62% to 63% of their weight in Cu; 0.18% to 0.24% of their weight in Pb; from 0.15% to 0.25% of their weight in Sn; from 0.3% to 0.08% of their weight in Si; from 0.10% to 0.15% of their weight in P; total of other elements≤0.30%, where Zn is present in a range approximately between 36% to 38%. Which allows a restriction in the amount of the generated Beta phase, thereby causing a lower deterioration of materials due to the loss of zinc throughout their exposure to ponded or low movement, slightly acid water, this dezincification effect is notoriously increased in alloys containing higher Beta phase amounts or thick and interrelated bands.

DETAILED DESCRIPTION

Figure 1:
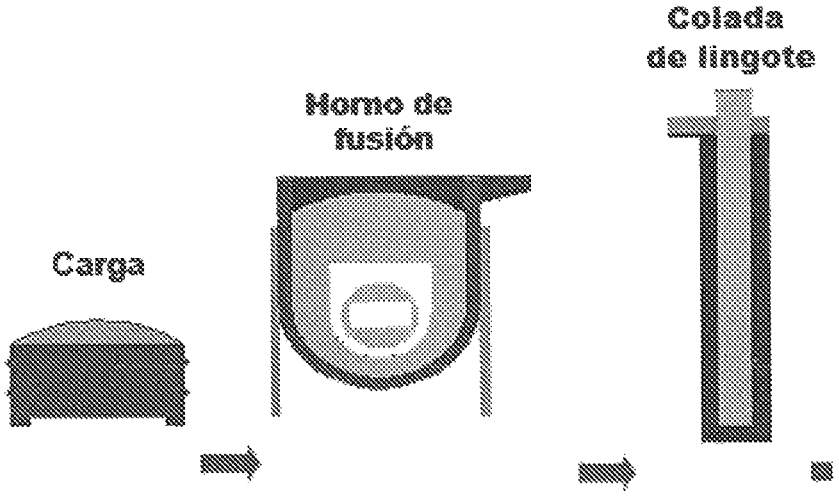
FIG. 1 represents the stationary heater for the cast of the alloy.
Figure 2:
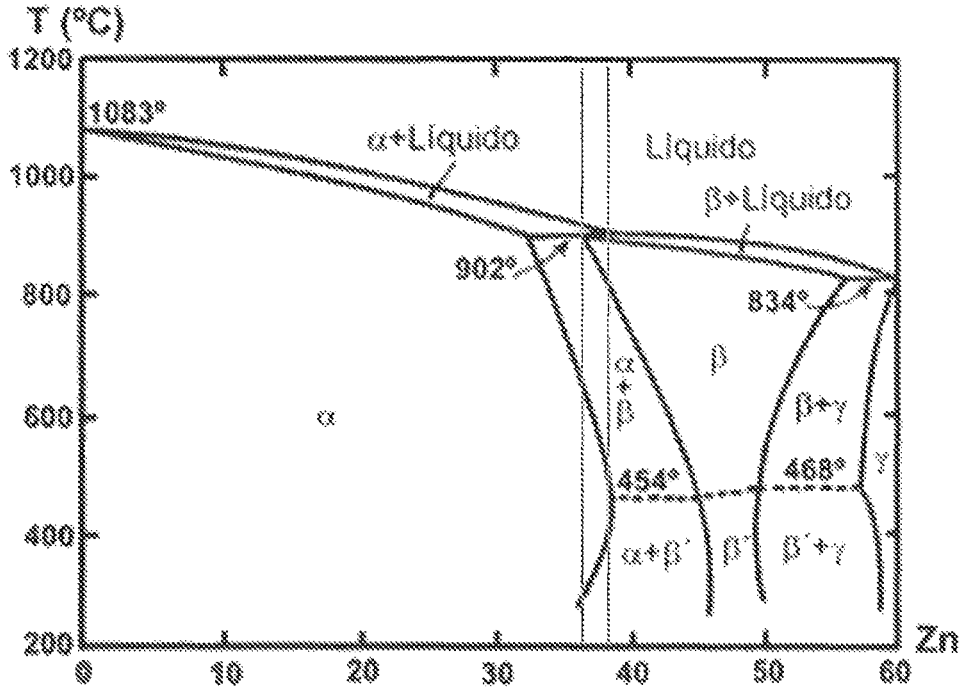
FIG. 2 is a phase Cu—Zn diagram.
Figure 3A:
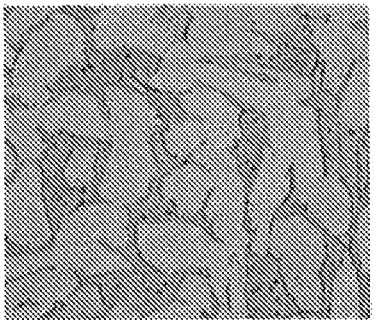
FIG. 3*a* is Al-3770 500×, 45% is a Beta phase. Very thick bands.

Developed chemical compounds include, for instance: 62Cu—0.18Pb—0.15Sn—0.03Si—0.10P, alloy C2802-A, and 63Cu—0.24Pb—0.25Sn—0.08Si—0.15P, alloy C2802-B, in which zinc is present in a range between 36% to 38%, which has the purpose of restricting of generated Beta phase in order to have thin bands only (FIG. 3*b*) and thereby causing a lower deterioration due to the loss of zinc throughout their exposure to ponded, low movement of slightly acids, this dezincification effect is notoriously increased in alloys containing higher Beta phase amounts or thick and interrelated bands (FIG. 3*a*).

The amount of lead used is so low that the same perfectly complies with the requirement of the law California AB 1953 in order to be considered as a lead free alloy and be used for the manufacturing of accessories for the conduction of water for human consumption, but at the same time significant, as the machinability of the alloy is increased, which will be of help in the breaking of shavings and lubrication throughout the machining process.

This alloy contains a relatively low amount of Beta phase that is too low to favor the machining of the same, but sufficient to keep an acceptable hot-forging level.

Manufacturing Process of Alloy 2802:

1. Casting

Stationary casting furnace cooled with water jacket

Throughout this development, the fact that in addition to complying with all lead and zinc loss resistance conditions, preventing the pollution of the rest of the alloys with external or harmful elements such as Sb, Bi, among others, is necessary. With this principle, we are able to recycle and reuse the same binary Cu—Zn alloys allowing the same, adding Copper-silicon and copper-phosphorus elements in order to complement the chemical compound.

The fusion of materials used for the manufacturing of the alloy is carried out in electrical induction furnace, which increases the molten metal's temperature up to 1100° C., to reach a homogenization period afterwards in order to reach a casting temperature of 1010° C.; the molten metal is casted in a vertical mold and is cooled with a water jacket.

In order to keep an acceptable but sustained machining level, a minimum lead level was needed in small percentages, which will be of help for the machining process, being ting and silicon the elements with the best behavior before the loss of Zinc. Machinability: 65%.

2. Hot Extrusion Process

Figure 5:
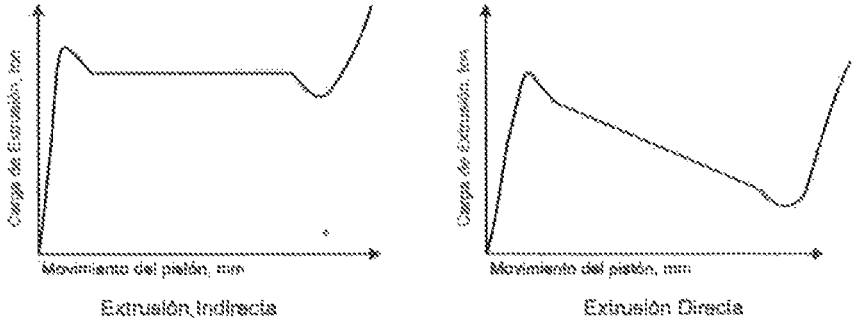
FIG. 5 is the piston's load-displacement ratio. Both in direct and indirect extrusion.

Extrusion is a process used in order to create objects with defined and fixed cross sections. The material is pushed or extracted through a die (extrusion die) with a cross section having the geometry of the intended product, the material flows then in the direction of the piston's movement, in the case of direct extrusion and through the same and in the case of indirect extrusion (FIG. 5).

In the case of brass, due to the strong deformations to which the material is subjected and both due to excessive loads to which said material is subjected, the process is carried out through hot extrusion, in this process, the bar subjected to extrusion is previously heated.

TABLE a

Chemical Composition of sample C2802-A

| Zn | Pb | Sn | P | Mn | Fe | Ni | Si | Cr | Te | A |
|---|---|---|---|---|---|---|---|---|---|---|
| 36.75 | 0.2152 | 0.186 | 0.133 | 0.00052 | 0.0028 | — | 0.0536 | — | 0.0083 | 0.00086 |

| Sb | Cd | Bi | Al | S | Se | Cu |
|---|---|---|---|---|---|---|
| 0.0023 | 0.0013 | — | — | 0.00022 | 0.0021 | 62.646 |

Forgeability: 70%

TABLE b

Chemical composition of sample C2802-B

| Zn | Pb | Sn | P | Mn | Fe | Ni | Si | Cr | Te | As |
|---|---|---|---|---|---|---|---|---|---|---|
| 36.83 | 0.1955 | 0.17 | 0.132 | 0.00034 | 0.0028 | — | 0.0379 | — | 0.0076 | 0.00088 |

| Sb | Cd | Bi | Al | S | Se | C |
|---|---|---|---|---|---|---|
| 0.0022 | 0.0014 | — | — | — | 0.0021 | 62.595 |

Forgeability: 70%

Figure 3B:
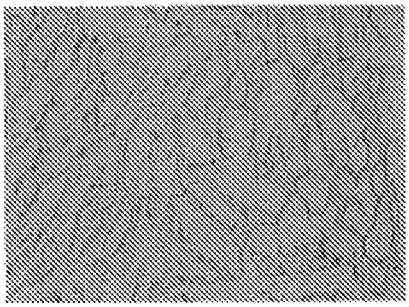
FIG. 3*b* is Al-2802 500×, 35% of Phase. Thin bands.
Figure 4:
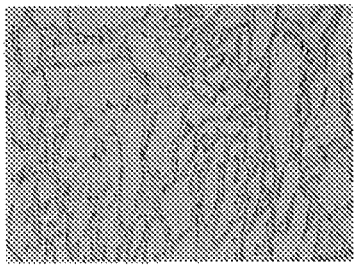
FIG. 4 represents the distribution of zinc in alloy 2802.

Due to the type of flow caused by this process, the beta phase bands are directed (stretched) in the sense longitudinal to the flow of the material during the extrusion process (FIG. 3*b*)

3. Bar Stretching

Figure 6:
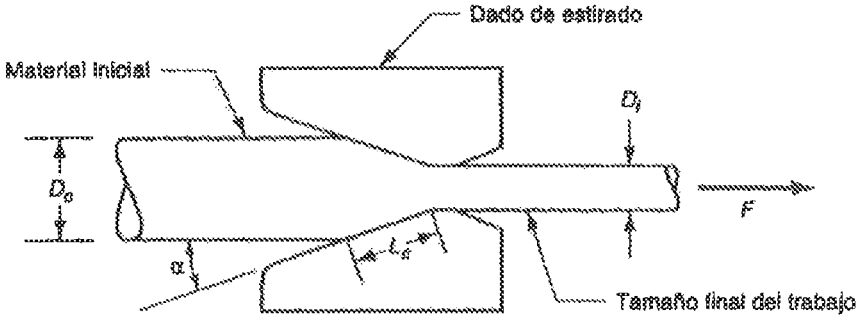
FIG. 6 represents the Stretching.

The last step of the manufacturing process is the obtaining of mechanical properties and adjustment of material tolerance, which is achieved through cold deformation, making a material go through previously manufactured geometry in a die such as the one disclosed in (FIG. 6). The stretching process is practically equal to the extrusion process, with the difference that in the stretching process, the material is pulled through a tool, while in the extrusion the material is pushed.

4. Mechanical Properties

Once the alloy has been obtained and having applied all of the steps of the manufacturing process in order to obtain a solid bar, the comparison between the mechanical properties and the C0360 alloy was carried out.

TABLE C

Comparison between 2 tubes with alloy 2802 Vs. one tube with brass 360

| Alloy | Resistance to Tension | Stretching Limit | Stretching % | HRB Hardness |
|---|---|---|---|---|
| 2802-A | 77.03 Ksi | 71.621 Ksi | 14.80% | 84 |
| 360 | 61.7 ksi | 56.228 ksi | 14.80% | 75 |
| 2802-B | 75.118 | 69.425 | 13.30% | 83 |

5. Zinc Loss Resistance Tests

Figure 7:
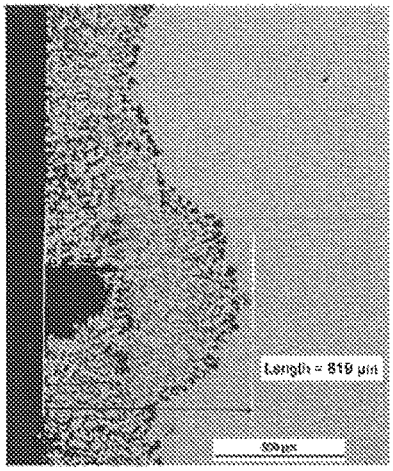
FIG. 7 is longitudinal dezincification Al-3770, 60% of the Beta phase.
Figure 8:
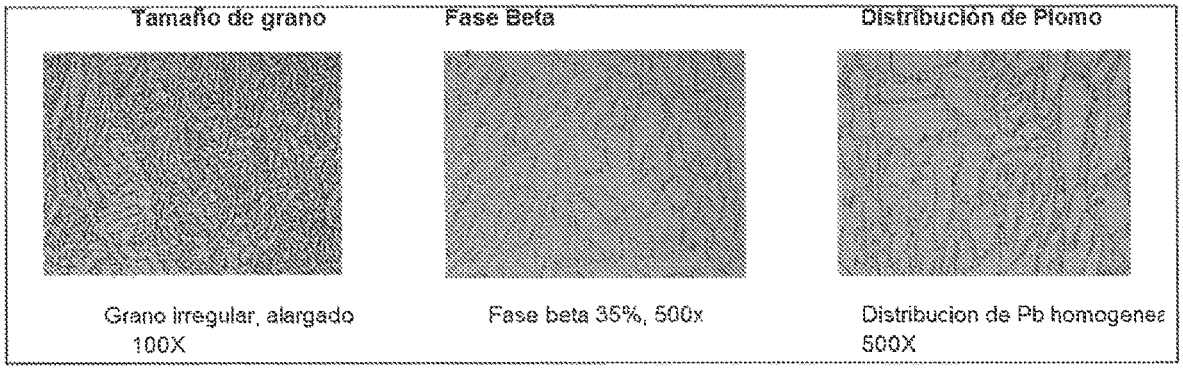
FIG. 8 represents Metallographies from sample A of alloy 2802.
Figure 9:
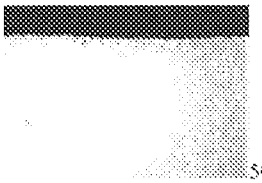
FIG. 9 shows dezincification results of sample "A", Stretched Bar.
Figure 9:
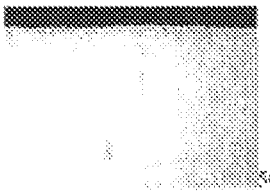
Figure 9:
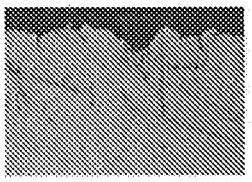
Figure 9:
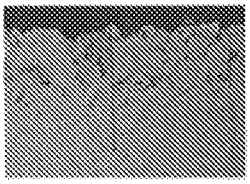
Figure 10:
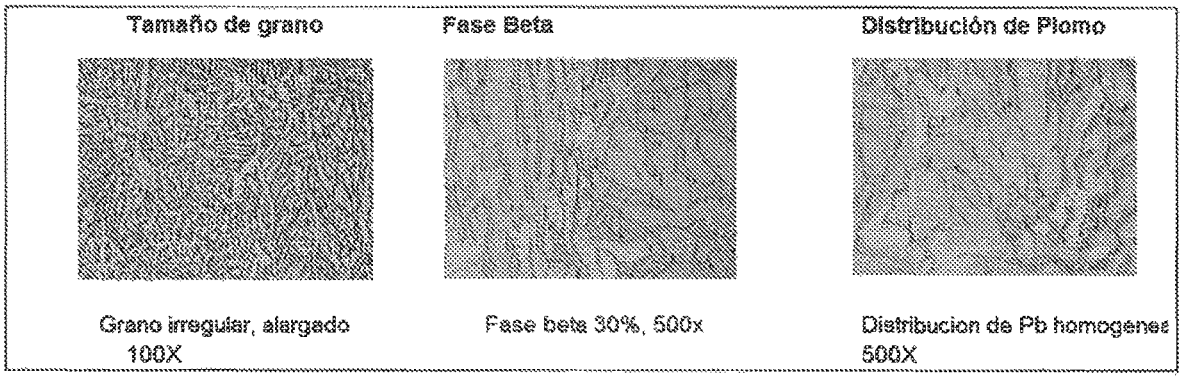
FIG. 10 represents Metallographies from Sample B of alloy 2802.
Figure 11:
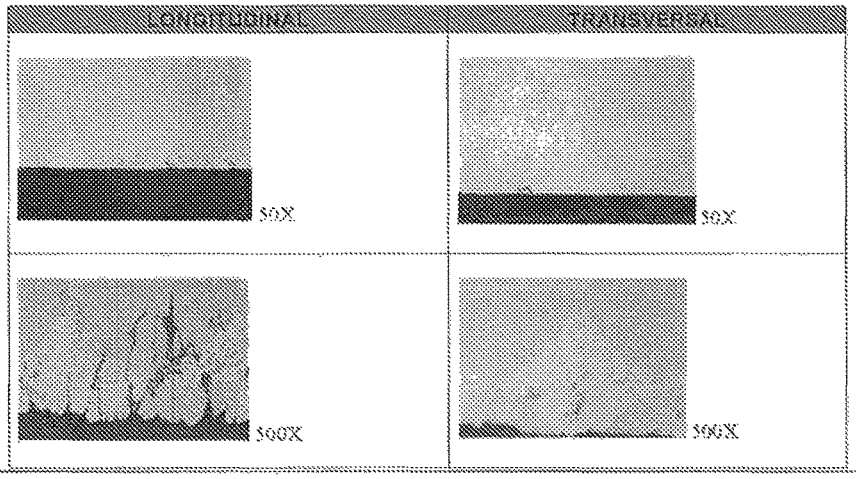
FIG. 11 shows dezincification results from sample "B". Stretched Bar.
Figure 12:
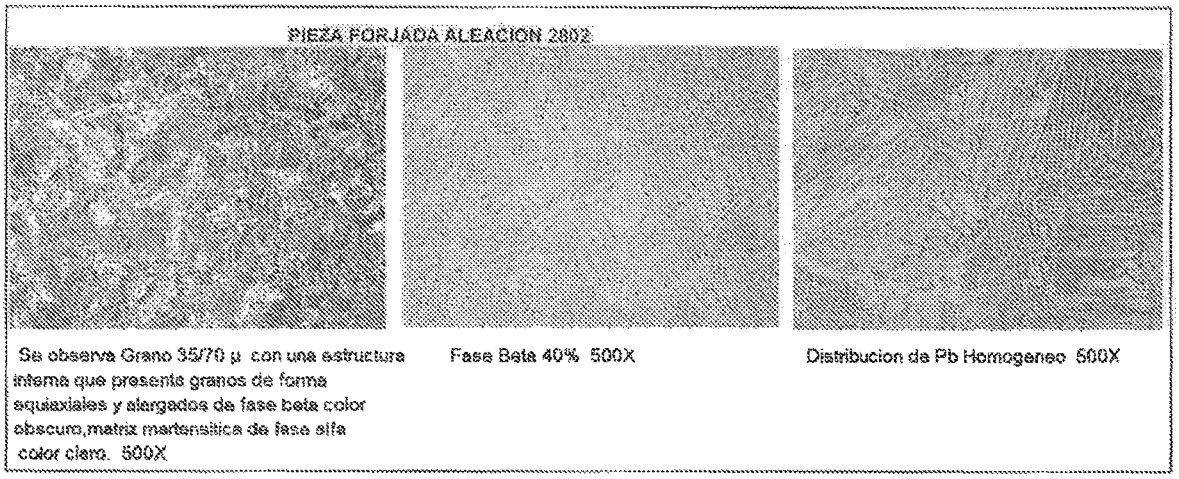
FIG. 12 represents Metallographies from the sample forged from alloy 2802-A.
Figure 13:
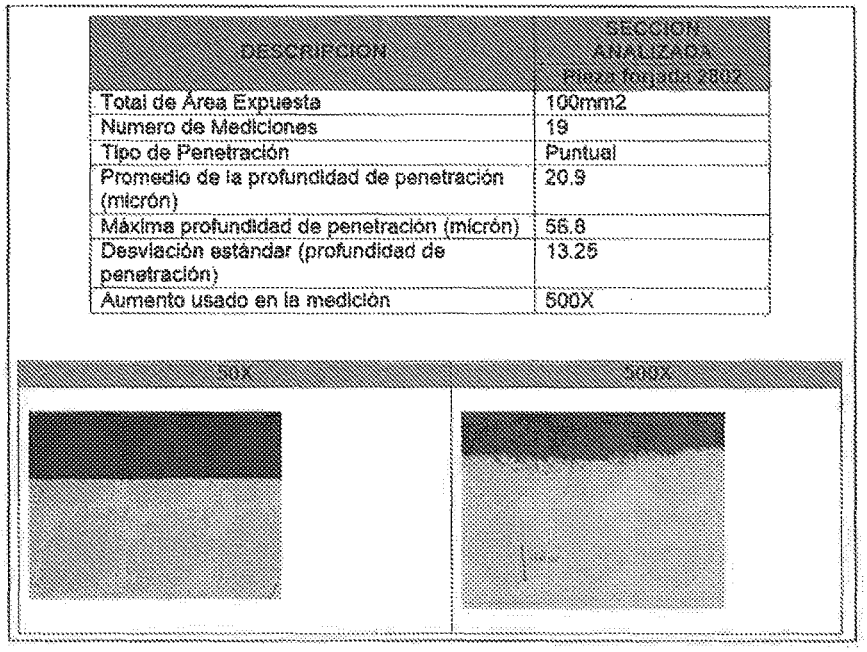
FIG. 13 shows dezincification results of a forged piece 2802-A

The dezincification phenomenon is basically a loss of zinc (FIG. 7) of the brasses in contact with ponded, slightly acid or low movement waters, leaving a porous mass with a very low mechanical resistance, such phenomenon was accelerated in accordance with the increased temperature.

In accordance with the picture (FIG. 7), the attack has been corrected by beta phase lines, said lines are interconnected through a complete net in the material's microstructure favoring the loss of Zinc.

5. Reference Standards for the Validation of Dezincification Resistance

All tests were carried out in accordance with the regulations of the standard ISO-6509-I and the same comply with the criteria contained in the regulation ISO-6509-II in order to be classified as a dezincification-resistant alloy.

Alloy 2802 reduces the damages caused by this phenomenon. Obtained results may be obtained in FIGS. 8 to 12.

The invention claimed is:

1. A composition of matter, comprising: 62% to 63% by weight of Cu; 0.18% to 0.24% by weight of Pb; from 0.15% to 0.25% by weight of Sn; from 0.3% to 0.08% by weight of Si; from 0.10% to 0.15% by weight of P; a total of other elements being 0.30% by weight or less, wherein Zn is present in a range approximately between 36% to 38% by weight.

2. The composition of matter according to claim 1, comprising, by weight:

| Zn | Pb | Sn | P | Mn | Fe | Si | Te | As |
|---|---|---|---|---|---|---|---|---|
| 36.75 | 0.2152 | 0.186 | 0.133 | 0.00052 | 0.0028 | 0.0536 | 0.0083 | 0.00086 |

| Sb | Cd | S | Se | Cu |
|---|---|---|---|---|
| 0.0023 | 0.0013 | 0.00022 | 0.0021 | 62.646. |

3. The composition of matter according to claim 1, comprising, by weight:

| Zn | Pb | Sn | P | Mn | Fe | Si | Te | As |
|---|---|---|---|---|---|---|---|---|
| 36.83 | 0.1955 | 0.17 | 0.132 | 0.00034 | 0.0028 | 0.0379 | 0.0076 | 0.00088 |

| Sb | Cd | Se | Cu |
|---|---|---|---|
| 0.0022 | 0.0014 | 0.0021 | 62.595. |

4. The composition of matter according to claim 1, having a forgeability of at least 70%.

5. A composition of matter according to claim 1, comprising a restricted amount of Beta phase generated and having thin bands only.

6. A composition of matter according to claim 1, which is resistant to dezincification according to the criteria from the standard ISO-6509-II.

7. A process of manufacturing a composition of matter of claim 1, the process comprising casting in a stationary furnace cooled with a water jacket casting a mixture with 62% to 63% of weight in Cu; 0.18% to 0.24% of weight in Pb; from 15% to 0.25% of weight in Sn; from 0.03% to 0.08% of weight in Si; from 0.10% to 0.15% of weight in P; a total of other elements 0.30%, and from 36% to 38% of Zn.

8. The process, according to claim 7, wherein the furnace is an electrical induction furnace which increases the molten metal's temperature up to 1100° C., to reach a homogenization period afterwards in order to reach a casting temperature of 1010° C.

9. The process, according to claim 8, wherein the molten metal is casted in a vertical mold and is cooled with a water jacket.

10. The process according to claim 7, wherein the process uses recycled Cu—Zn binary alloys.

11. The process, according to claim 10, wherein a copper-silicon and copper-phosphorus are added in order to complement the chemical composition.

12. The process, according to claim 7 wherein small percentages of tin and silicon have been added.

* * * * *